US007415976B1

(12) United States Patent
Powell

(10) Patent No.: US 7,415,976 B1
(45) Date of Patent: Aug. 26, 2008

(54) PITCHING APPARATUS AND METHOD

(76) Inventor: Richard O. Powell, P.O. Box 19491, Austin, TX (US) 78760

( * ) Notice: Subject to any disclaimer, the term of this patent is extended or adjusted under 35 U.S.C. 154(b) by 0 days.

(21) Appl. No.: 11/350,603

(22) Filed: Feb. 9, 2006

(51) Int. Cl.
*F41B 3/00* (2006.01)

(52) U.S. Cl. ..... 124/16; 124/7; 124/36

(58) Field of Classification Search ..... 124/7, 124/8, 16, 17, 36
See application file for complete search history.

(56) References Cited

U.S. PATENT DOCUMENTS 3,254,639 A * 6/1966 Laird ..... 124/7
3,601,112 A * 8/1971 Dale ..... 124/8
4,111,179 A * 9/1978 Hashimoto ..... 124/7
4,906,001 A * 3/1990 Vaughn ..... 473/438
5,660,386 A * 8/1997 Krieger ..... 124/7
6,129,076 A * 10/2000 Powell et al. ..... 124/7
6,546,923 B2 * 4/2003 Erickson ..... 124/16
6,616,555 B2 * 9/2003 Bewley ..... 473/451

* cited by examiner

*Primary Examiner*—John Ricci
(74) *Attorney, Agent, or Firm*—J. Nevin Shaffer, Jr.

(57) ABSTRACT

A pitching apparatus includes a support base and an upright attached to the support base. A ball support with a power section is attached to the upright. A cocking arm is attached to the upright and a release handle is attached to the cocking arm.

18 Claims, 5 Drawing Sheets

PITCHING APPARATUS AND METHOD

FIELD OF THE INVENTION

This invention relates to a pitching apparatus and method. In particular, according to one embodiment, the invention relates to a pitching apparatus including a support base and an upright attached to the support base. A ball support with a power section is attached to the upright. A cocking arm is attached to the upright and a release handle is attached to the cocking arm.

BACKGROUND OF THE INVENTION

Applicant has continued to examine the mechanics of throwing a ball since his U.S. Pat. No. 6,129,076 issued. That throwing apparatus and method marked a distinct improvement in the art of throwing machines in many ways. Nonetheless, there are several features of that state of the art invention that are problematical. First, that throwing machine requires the ball to be added after the device is in the cocked or armed position. Second, speed and direction corrections are not easily made between throws. Third, while gross up and down correction is possible, no subtle raising or lowering of the pitch is possible and no side to side corrections are enabled without moving the entire base. And, finally, no choice of speed and direction is enabled after speed and direction settings have been made.

Thus, there is a need in the art for providing a pitching machine to which the ball can be added prior to cocking the device; that easily allows for speed and direction corrections between throws; that also enables the user to adjust the pitch up and down and from side to side without moving the base and that provides a user with a choice of speed and direction settings after the settings have been made and during the process of cocking the device to throw a pitch. It, therefore is an object of this invention to provide an improved pitching apparatus and method that is easy and safe to use, that is inexpensive and easy to transport and set up and that throws a ball accurately with the desired velocity over a range of possible velocities.

SUMMARY OF THE INVENTION

Accordingly, the pitching apparatus and method of the present invention includes a support base to which an upright is attached. A ball support with a power section is attached to the upright. A cocking arm is attached to the upright and a release handle is attached to the cocking arm.

According to a further aspect of the invention, a speed adjuster and a height adjuster are provided. According to another aspect, a cupped ball holder is movably connected to the ball support. In a further aspect, the ball support includes a pair of J-shaped supports. In another aspect of this invention, the ball support includes a male connector and the release handle includes a female connector. According to a further aspect, the male connector is a lock bar and the female connector is at least one latch notch.

According to a further aspect, a height adjuster and a speed adjuster is attached to the ball support and a height adjuster and a speed adjuster attached to the upright. In another aspect, the upright is rotatable side to side. According to another aspect, the upright is rotatable front to back.

According to another embodiment of the invention, the pitching apparatus includes a support base with an upright attached to the support base. A ball support with a power section is attached to the upright. A cocking arm is attached to the upright and a release handle is attached to the cocking arm. Further, a height adjuster and a speed adjuster are provided.

According to a further aspect of this invention, at least one height adjuster and speed adjuster are attached to the ball support and at least one height adjuster and speed adjuster are attached to the upright. In another aspect, the ball support includes a lock bar and the release handle includes at least one latch notch. In another aspect, the upright is rotatable side to side and front to back. In a further aspect of this invention, a cupped ball holder is movably connected to the ball support. In a further aspect, the ball support includes a pair of J-shaped supports.

According to another embodiment, a method for throwing a ball includes providing a support base and attaching an upright to the support base. A ball support is attached to the said upright and a power section is attached to the ball support. Next, a cocking arm is attached to the upright and a release handle is attached to the cocking arm. A ball is placed in the ball support and the cocking arm and the release handle are moved so that the release handle connects with the ball support. Then, the cocking arm and the release handle connected to the ball support are moved to a cocked position. And then, the release handle is moved so that the connection with the ball support is released and the ball support is moved by the power section so that the ball is thrown.

According to a further aspect of this invention, the method includes the step of providing a speed adjuster and a height adjuster. According to another aspect, the power section is a spring. According to another aspect, the step of movably attaching a cupped ball holder to the ball support is added. And, in another aspect, the ball support includes a pair of J-shaped supports.

DESCRIPTION OF THE DRAWINGS

Other objects, features and advantages of the present invention will become more fully apparent from the following detailed description of the preferred embodiments, the appended claims, and the accompanying drawings in which:

DETAILED DESCRIPTION OF THE INVENTION

Figure 1:
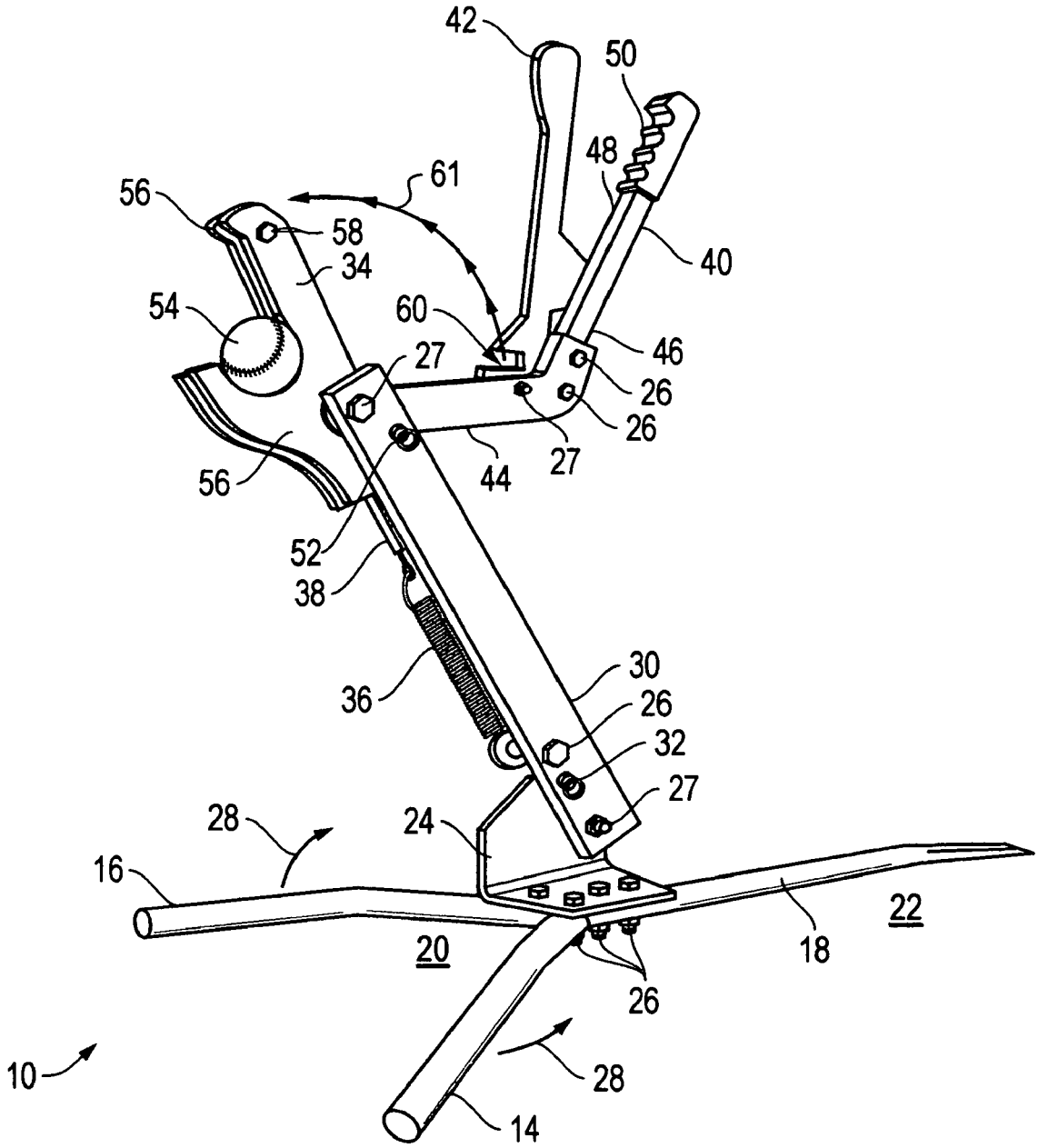
FIG. 1 is a plan view of the pitching apparatus according to an embodiment of the present invention in the uncocked position with a ball loaded.

The preferred embodiment of the present invention is illustrated by way of example only and not by limitation in FIGS. 1-6. With specific reference to FIGS. 1 and 2, the pitching apparatus 10 of the present invention includes support base 12. As illustrated, support base 12 is "Y" shaped with three legs, leg 14, leg 16 and leg 18. Legs 14 and 16 form the spread apart portion of the "Y" and are at the front 20 of the support base 12. Leg 18 is a single leg and extends to the back 22 of the support 12. This "tri-pod" configuration allows the support base 12 to be easily moved and securely located even on irregular or uneven surfaces. The front 20 fully supports the pitching apparatus 10 and prevents it from rocking from side to side during the pitching process as will be discussed more fully hereafter. Legs 14, 16 and 18 are attached to support bracket 24 by bolts 26, one bolt 26 each for legs 14 and 16 and two bolts 26 for leg 18. One unique feature of the pitching apparatus 10 is that the bolts 26 holding legs 14 and 16 in place may be loosened and legs 14 and 16 rotated in the direction of direction arrows 28 so as to align with leg 18. This creates a very compact and easily transportable package when moving and/or storing pitching apparatus 10.

Support bracket 24 is connected to support base 12 by bolts 26. Upright 30 is attached to support bracket 24 by bolts 27 and position pull pin 32. FIG. 1 shows upright 30 with position pull pin 32 located in the "Fast" position as will be discussed more fully hereafter with regard to FIG. 6. Bolts 27 are differentiated from bolts 26 in that bolts 27 enable a moving connection.

Ball support 34 is movably connected to upright 30 by bolt 27. Power section 36 is connected to ball support 34 and to upright 30. According to one embodiment, power section 36 is a spring that is capable of throwing a baseball up to thirty miles per hour. Obviously, power section 36 may be any device that provides power to move ball support 34 as will be described more fully hereafter, including by way of example only and not by limitation elastic and or rubber tubing. Other power sections 36 may be selected for throwing a ball fifty-five miles per hour, seventy-five mile per hour, and higher as desired.

Power section 36 is connected to ball support 34, according to one embodiment, by means of a turnbuckle 38. Turnbuckle 38 is adjustable as is known in the art so as to stretch or release power section 36 as desired and as will be described more fully hereafter with regard to FIGS. 5 and 6. On the other end, power section 36 is connected to upright 30 by bolt 26.

Cocking arm 40 is movably connected to upright 30 and release handle 42 is movably connected to cocking arm 40 by bolts 27 or any other attachment device now known or hereafter developed. As illustrated, cocking arm 40, in order to make the device as compact as possible for shipping and storage, comes in two parts, part 44 attached directly to upright 30 as discussed above with bolt 27 and as illustrated and part 46 which forms the extended end 48 with a grip 50 which is connected to part 44 by bolts 26. Obviously, cocking arm 40 can be made in a single piece if desired.

Figure 2:
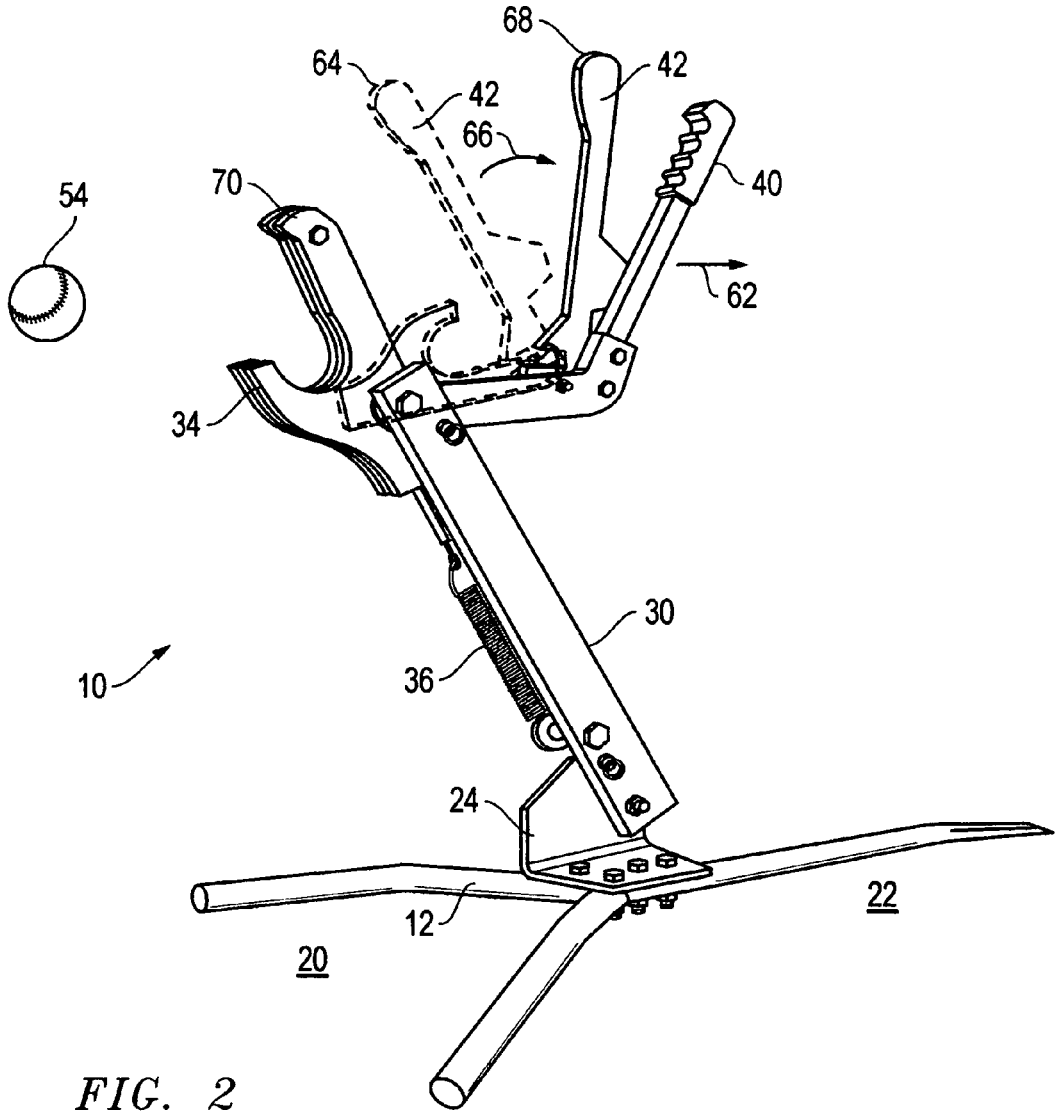
FIG. 2 is a plan view of the invention of FIG. 1 in the cocked position and in the ball released position.

FIGS. 1 and 2 also illustrate position pull pin 52 which regulates how far back cocking arm 40 may be pulled and shows ball 54 located in ball support 34. These figures also illustrate another aspect of the invention where the ball support 34 includes a pair of spaced apart, essentially "J" shaped arms 56. According to one embodiment, J-shaped arms 56 are spaced apart by a bolt 58 (more clearly shown in FIGS. 4A, 4D, 5 and 6). The exposed shank (See e.g. FIG. 4A) of bolt 58 between J-shaped arms 56 cooperates as the male member of a connection system including female member notch 60 in release handle 42. When release handle 42 is moved in the direction of direction arrows 61 contact and a connection is made between the notch 60 and the bolt 58.

Referring now specifically to FIG. 2, to throw a ball 54 the user has moved the cocking handle toward the front 20 of pitching apparatus 10 so that notch 60 falls over bolt 58 which acts as a lock bar thus capturing ball support 34. Then, cocking arm 40 is moved in the direction of direction arrow 62 until stopped by position pull pin 52. Moving cocking arm 40 also moves release handle 42 and captured ball support 34 to the position illustrated in dotted lines. While holding cocking arm 40 is in the "cocked" position illustrated in the figure, release handle 42 is in "cocked" position 64 shown in dotted lines (See also FIG. 4C). Pulling release handle 42 in the direction of direction arrow 66, moves the release handle 42 to the release position 68 where bolt 58 is released from notch 60 allowing power section 36 to rapidly contract and pull the base of ball support 34 downward. Ball 54 rides ball support 34 some distance and is then projected away from pitching apparatus 10. Depending on the set up of the pitching apparatus 10, as will be discussed more fully hereafter, the upper ends 70 of ball support 34 may be curved as illustrated so as to ensure that the ball 54 is released in the forward direction and not up in the air.

Figure 3:
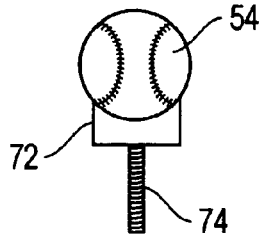
FIG. 3 is a front view of the cupped ball holder of the invention.

Referring now to FIG. 3, another aspect of the invention is illustrated where a cupped ball holder 72 is illustrated. Preferably, cupped ball holder 72 is connected to ball support 34 by a screw 74 that allows cupped ball holder 72 to be adjusted up and down within ball support 34. When cupped ball holder 72 is screwed upward, the pitch location at the hitting/catching location is raised. When the cupped ball holder 72 is screwed downward, the pitch location is lowered. The cupped shape helps hold the ball 54 in position during the cocking procedure.

Figure 4A:
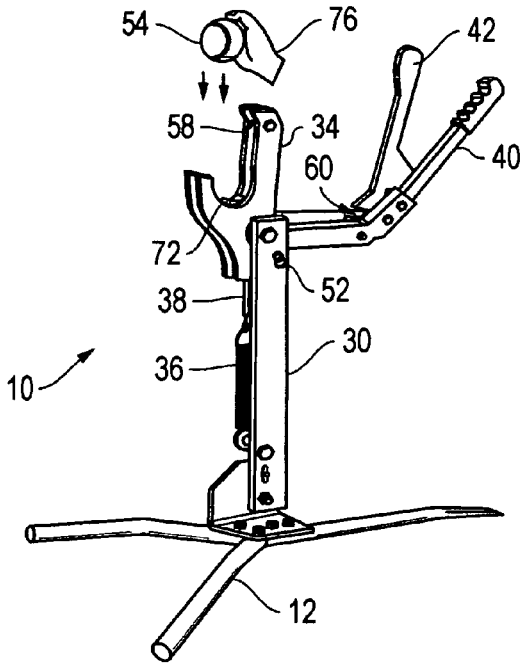
FIGS. 4A-4D are side views of the invention of FIG. 1 showing the step by step process of using the invention to throw a ball.

Referring now to FIGS. 4A-D, the use of pitching apparatus 10 will be discussed in a step by step detail. FIG. 4A shows step one of using the pitching apparatus 10 of the present invention where ball 54 is placed on cupped ball holder 72 in ball support 34. It is a unique feature of this invention that the pitching apparatus is in the "uncocked" position at this step. That is, in this position nothing that the user may do will cause the ball 54 to be thrown or any of the operating parts to move. Thus, user's hand 76 is never in danger of being hit by any part of the machine while placing the ball 54.

Figure 4B:
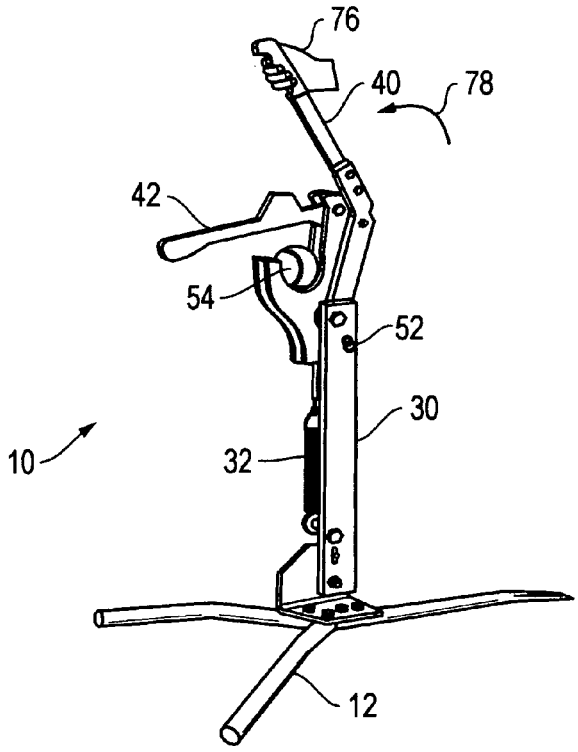
Figure 4C:
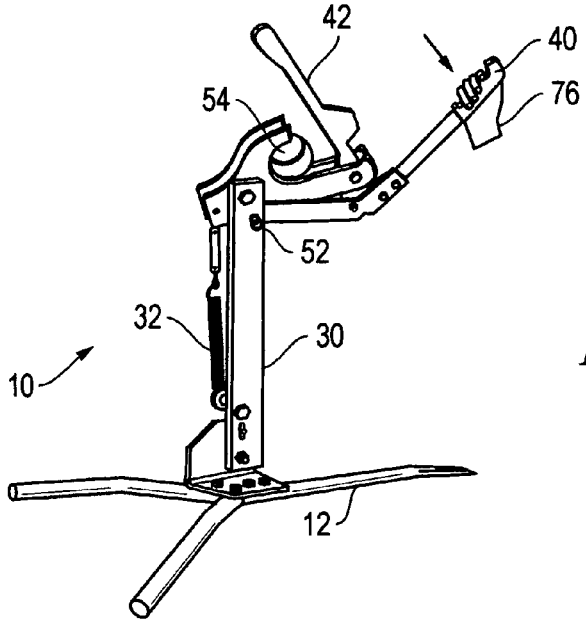
Figure 4D:
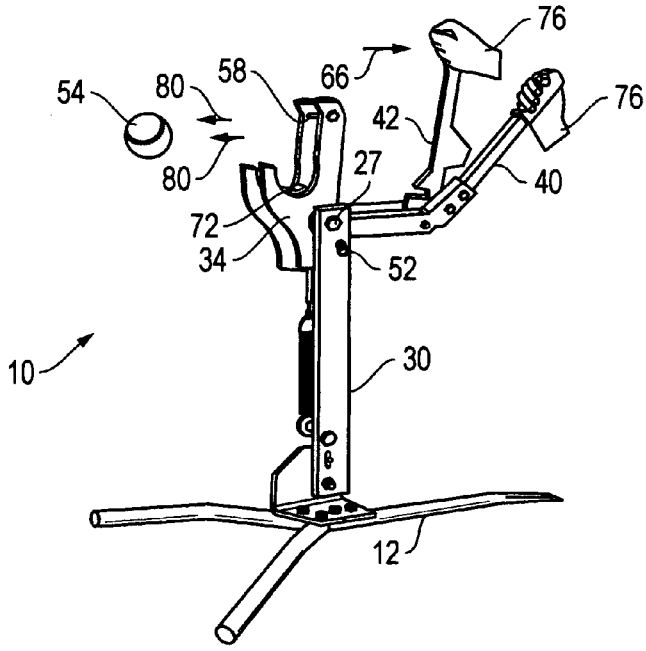

FIG. 4B shows the next step where cocking arm 40 is moved in the direction of direction arrow 78 toward the front 20 until release handle 42 falls forward and notch 60 catches on bolt 58. Then, in FIG. 4C, cocking arm 40 is pulled back and held in the cocked position against the position pull pin 52. Pulling cocking arm 40 back also pulls release handle 42 and ball support 34 as shown. Finally, in FIG. 4D, to pitch the ball 54, the user, while holding the cocking arm 40 steady, uses the other hand to pull back release handle 42 in the direction of direction arrow 66. This causes notch 60 to be moved out of connection with bolt 58 thus releasing ball support 34 to be rapidly pulled by power section 36 and to rotate rapidly about bolt 27 so as to cause ball 54 to be thrown out of contact with ball support 34 and thrown in the direction of direction arrows 80.

Figure 5:
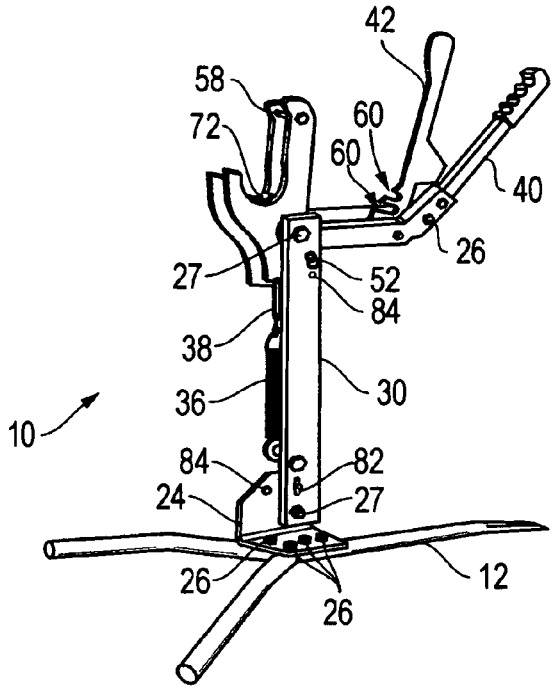
FIG. 5 is a plan view of the invention illustrating slow speed settings.
Figure 6:
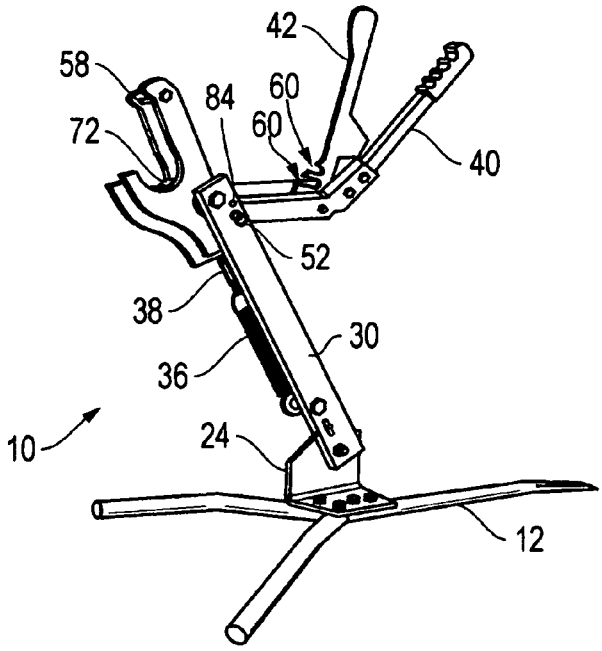
FIG. 6 is a plan view of the invention illustrating fast speed settings.

Referring now to FIGS. 5 and 6, other unique advantages of the pitching apparatus and method are discussed. According to one embodiment the speed and direction of ball 54 when thrown may be rapidly and easily set and changed. FIG. 5 illustrates the "slow" settings and FIG. 6 illustrates the "fast" settings.

FIG. 5 shows turnbuckle 38 with no tension added to power section 36 so that the turnbuckle may said to be "loose". Further, upright 30 is in a vertical position, essentially at right angles to support base 12 and held in that position by wing nut 82 instead of position pull pin 32 as shown in FIGS. 1 and 2. The function of wing nut 82 is the same as the function of position pull pin 32 to cooperate with support bracket 24 to hold upright 30 in the chosen position. Other positions may be made available by forming other through holes 84 into which wing nut 82 or position pull pin 32 may be placed as shown in FIG. 6. Obviously, wing nut 82 can be used in connection with a continuous hole around the edge of support bracket 24 to replace a series of through holes 84 if desired.

Likewise, FIG. 5 shows position pull pin 52 in place in a through hole 84 near the top of upright 30 with another through hole 84 located below. This limits the movement of cocking arm 40 as shown thus keeping the tension on power section 36 reduced as opposed to the position of pull pin 52 shown in FIG. 6. Pull pin 52 also affects the direction of the ball, along with cupped ball holder 72, in that the farther back cocking arm 40 is pulled the higher the ball 54 will be in the hitting/catching zone when it arrives.

Two more unique features of the invention are illustrated by these figures. As shown, release handle 42 includes, according to one embodiment, more than one notch 60. This enables the user, after the chosen speed and direction settings have been selected and set, to alter the pitch from one throw to another simply by changing the choice of notches 60 used. Batters will not know what speed or position the ball is coming from one throw to another with no time lost in between pitches making tedious adjustments.

Another unique feature allows the support bracket 24 to rotate left and right on bolts 26 a small amount, such as for example only, one eighth of an inch. This allows the user to quickly change the location of the pitch, one pitch after the other simply and easily. This feature requires only that the bolt holes for bolts 26 in support bracket be slightly enlarged and the bolts 26 left slightly loose. Likewise, according to one embodiment, wing nut 82 or position pull pin 32 may also be used in conjunction with a slightly enlarged through hole 84. This allows the user to move support stand 30 slightly forward or backward after the device is in the "cocked position". This provides the user the ability to "move" the pitch around the strike zone from pitch to pitch so that batters can never predict exactly where the ball will be as is the case with live pitchers. In use the cocking arm 40 is pulled all the way back to the "cocked position". The release handle 42 may be operated from that fully "cocked" position and the ball 54 will cross the plate in one location. With the exact same motion, the user can, according to this embodiment, slightly move the support 30 left or right or front and back and move the ball around the strike zone. The movement that is required in order to affect the location at the strike zone is so slight that a batter can not detect it.

Referring now to FIG. 6, the "fast" settings are illustrated where turnbuckle 38 is twisted, as is known in the art, tight for maximum tension on power section 36. Also, position pull pin 52 is placed in through hole 84 lower on upright 30 thus allowing cocking arm 40 to be pulled back farther. And, further, upright 30 has been moved to the forward leaning position as illustrated using through holes 84 in support base 24 as discussed above. All of these options, separately and together, increase the speed of the thrown ball 54.

By way of the present invention, then, a safe, easy to use, and extremely accurate pitching apparatus and method 10 is provided. Applicant has determined that baseballs, plastic balls and balls of all types may be used with the invention. Speeds of up to thirty miles per hour are easily achieved with inexpensive materials such as plastic. In fact, simply by changing the materials and spring tensions, slower speeds acceptable for use as toys with children all the way up to major league baseball speeds are easily accommodated.

While the present invention has been disclosed in connection with the preferred embodiment thereof, it should be understood that there may be other embodiments which fall within the spirit and scope of the invention as defined by the following claims.

What is claimed is:

1. A pitching apparatus comprising:

a) a support base;

b) an upright attached to said support base;

c) a ball support with a power section attached to said upright;

d) a cocking arm attached to said upright; and e) a release handle releasably connected with said cocking arm wherein said ball support includes a male connector and said release handle includes a female connector such that said female connector is conformed to releasably connect with said male connector.

2. The apparatus of claim 1 further comprising a speed adjuster and a height adjuster.

3. The apparatus of claim 1 further comprising a cupped ball holder movably connected to said ball support.

4. The apparatus of claim 1 wherein said male connector is a lock bar and wherein said female connector is at least one latch notch.

5. The apparatus of claim 1 further comprising a height adjuster and a speed adjuster attached to said ball support and a height adjuster and a speed adjuster attached to said upright.

6. The apparatus of claim 1 wherein said upright is rotatable side to side.

7. The apparatus of claim 1 wherein said upright is rotatable front to back.

8. The apparatus of claim 1 wherein said wherein said ball support includes a pair of J-shaped supports.

9. A pitching apparatus comprising:

a) support base;

b) an upright attached to said support base;

c) a ball support with a power section attached to said upright wherein said ball support includes a pair of J-shaped supports;

d) a cocking arm attached to said upright;

e) a release handle releasably connected with said cocking arm; and f) a height adjuster and a speed adjuster.

10. The apparatus of claim 9 wherein at least one height adjuster and speed adjuster are attached to said ball support and wherein at least one height adjuster and speed adjuster are attached to said upright.

11. The apparatus of claim 9 wherein said ball support includes a lock bar and wherein said release handle includes at least one latch notch.

12. The apparatus of claim 9 wherein said upright is rotatable side to side and front to back.

13. The apparatus of claim 9 further comprising a cupped ball holder movably connected to said ball support.

14. A method for throwing a ball comprising:

a) providing a support base with an attached upright with a ball support, a power section and a cocking arm with a release handle releasably connected with said cocking arm;

b) placing a ball in said ball support;

c) moving said cocking arm and said release handle so that said release handle connects with said ball support;

d) moving said cocking arm and said release handle connected to said ball support to a cocked position; and e) moving said release handle so that the connection with said cocking arm and said ball support is released and said ball support is moved by said power section so that said ball is thrown.

15. The method of claim 14 further comprising the step of moving the upright left or right and forward or backward.

16. The method of claim 14 further comprising the step of movably attaching a cupped ball holder to said ball support.

17. The method of claim 14 wherein said ball support includes a pair of J-shaped supports.

18. The method of claim 14 further comprising the step of providing a speed adjuster and a height adjuster.

* * * * *